US005512190A

United States Patent [19]

Anderson et al.

[11] Patent Number: 5,512,190

[45] Date of Patent: Apr. 30, 1996

[54] LUBRICATING OIL COMPOSITION PROVIDING ANTI-WEAR PROTECTION

[75] Inventors: Gregory P. Anderson, Pleasant Valley; Julian H. Dancy, Poughkeepsie; Doris Love, Fishkill; Jayne M. Lucas, Campbell Hall, all of N.Y.

[73] Assignee: Texaco Inc., White Plains, N.Y.

[21] Appl. No.: 293,260

[22] Filed: Aug. 22, 1994

[51] Int. Cl.[6] ..... C10M 135/36

[52] U.S. Cl. ..... 252/47; 252/48.6; 252/49.6; 548/141; 548/142

[58] Field of Search ..... 252/47, 47.5, 49.6, 252/48.6, 46.4; 548/141, 142; C10M 135/36, 129/74, 129/76

[56] References Cited

U.S. PATENT DOCUMENTS 4,301,019 11/1981 Horodysky et al. ..... 252/49.6
4,584,114 4/1986 Gemmill et al. ..... 252/47.5
4,758,361 7/1988 Karol ..... 252/48.6
4,765,918 8/1988 Love et al. ..... 252/46.4

FOREIGN PATENT DOCUMENTS 209730 1/1987 European Pat. Off. .

*Primary Examiner*—Stephen Kalafut
*Assistant Examiner*—Cephia D. Toomer
*Attorney, Agent, or Firm*—Kenneth R. Priem; George J. Darsa

[57] ABSTRACT

The present invention provides a lubricating oil additive which provides anti-wear properties to a lubricating oil. The additive is the reaction product of 2,5-dimercapto-1,3,4-thiadiazole and a mixture of unsaturated mono-, di-, and tri-glycerides. The present invention also provides a lubricating oil additive with anti-wear properties produced by reacting a mixture of unsaturated mono-, di-, and tri-glycerides with diethanolamine to provide an intermediate reaction product and reacting the intermediate reaction product with 2,5-dimercapto-1,3,4-thiadiazole.

24 Claims, No Drawings

LUBRICATING OIL COMPOSITION PROVIDING ANTI-WEAR PROTECTION

BACKGROUND OF THE INVENTION

1. Field of the Invention

This invention relates to a novel lubricating oil additive having anti-wear properties and to a lubricating oil composition containing the novel additive. More specifically, this application relates to a novel additive reaction product prepared in a reaction between a mixture of mono-, di-, and tri-glycerides and 2,5-dimercapto-1,3,4-thiadiazole. In a preferred reaction, the mixture of mono-, di-, and tri-glycerides is first reacted with diethanolamine to form an intermediate reaction product which is then reacted with the 2,5-dimercapto-1,3,4-thiadiazole. 2. Description of Related Information Current commercial lubricating oil anti-wear additives can contain phosphorus and zinc. While these additives provide effective anti-wear protection, they exhibit problematic side effects. During operation of an internal combustion engine, lubricating oil enters the combustion chambers by means such as clinging to cylinder walls as the piston makes its down stroke. When phosphorus containing lubricating oil compositions enter the combustion reaction, phosphorus enters the exhaust stream and acts to poison the catalytic converter, thus shortening its life. In addition, the presence of zinc contributes to the emission of particulates in the exhaust.

It would be advantageous, therefore, to provide a lubricating oil additive which does not contain phosphorus or zinc. Applicants have discovered a lubricating oil anti-wear additive which does not contain these elements and which provides superior anti-wear protection as compared to typical phosphorus and zinc containing additives.

SUMMARY OF THE INVENTION

The present invention provides a lubricating oil additive which imparts antiwear properties to a lubricating oil. The additive is the reaction product of 2,5-dimercapto-1,3,4-thiadiazole and a mixture of unsaturated mono-, di-, and tri-glycerides of formula:

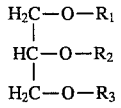

where $R_1$, $R_2$ and $R_3$ comprises hydrogen or a hydrocarbyl radical having the formula:

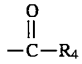

where $R_4$ is a $C_6$ to $C_{24}$ hydrocarbon.

In an alternative embodiment, the present invention provides a lubricating oil additive with anti-wear properties produced by the steps comprising:

reacting a mixture of unsaturated mono-, di-, and tri-glycerides of formula:

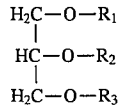

where $R_1$, $R_2$ and $R_3$ comprise hydrocarbyl radicals, or a mixture of hydrogen and hydrocarbyl radicals, having the formula:

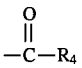

where $R_4$ is a $C_6$ to $C_{24}$ hydrocarbon, with diethanolamine to provide an intermediate reaction product comprising a second mixture of mono-, di-, and tri-glycerides and esters and amides of fatty acids; and reacting the intermediate reaction product with 2,5-dimercapto-1,3,4thiadiazole.

A lubricating composition comprising a lubricating oil and the additive of the present invention is also contemplated.

The additives of the invention impart anti-wear properties to lubricating oil compositions without introducing phosphorus into the exhaust gases where it can poison the catalytic converter.

DETAILED DESCRIPTION OF THE INVENTION

In a first embodiment, the additive composition of the present invention comprises the reaction product of a mixture of unsaturated mono-, di-, and tri-glycerides and 2,5-dimercapto-1,3,4-thiadiazole (DMTD).

The first reactant used in making the additive of the present invention is a mixture of unsaturated mono-, di-, and tri-glycerides of formula:

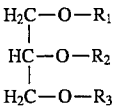

where $R_1$, $R_2$ and $R_3$ comprises hydrogen or a hydrocarbyl radical having the formula:

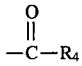

where $R_4$ is a $C_6$ to $C_{24}$ hydrocarbon. These mixtures can be naturally occurring, e.g., coconut oil, sunflower oil, lard, palm oil, etc., or can be synthesized by reaction of glycerol with fatty acids, e.g., oleic acid. Although we describe the first component as a mixture of mono-, di-, and tri-glycerides, pure mono-, di-, or tri-glycerides would be effective as well. However, the naturally occurring oils are mixtures, and the synthesis described above produces a mixture. It would not be economically feasible to isolate pure mono-, di-, or tri-glycerides. Typical mixtures of unsaturated mono-, di-, and tri-glycerides employed for preparing the additive composition of the present invention include glycerol oleates, and preferably glycerol monooleate, glycerol linoleate and glycerol linolenate.

The second reactant, 2,5-dimercapto-1,3,4-thiadiazole, is represented by the formula:

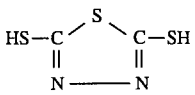

and can be purchased from R. T. Vanderbilt of Norwalk, Conn.

The mixture of unsaturated mono-, di-, and tri-glycerides and DMTD is reacted in proportions based upon the double bond equivalents in the mixture of unsaturated mono-, di-, and tri-glycerides. In its broadest embodiment, the ratio of double bond equivalents of the mixture of unsaturated mono-, di-, and tri-glycerides to moles of DMTD is a ratio between about 4:1 and about 0.5:1. Preferably, the ratio is between about 2:1 and about 1:1. The number of double bond equivalents can be determined by the iodine number test, AOCS Cd 1-25. The reaction is conducted under a nitrogen atmosphere, combined at ambient temperature, then heated to about 120° C.–140° C. under a nitrogen atmosphere for about 2–6 hours, then filtered. It is postulated that the DMTD adds across the double bonds of the mixture of unsaturated mono-, di-, and tri-glycerides as follows:

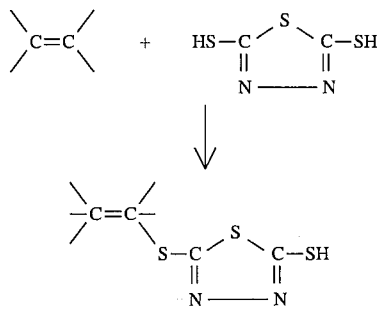

In a preferred second embodiment, the mixture of unsaturated mono-, di-, and tri-glycerides is first reacted with diethanolamine (DEA) to provide an intermediate product comprising unsaturated mono-, di-, and tri-glycerides and esters and amides of fatty acids. The unsaturated mono-, di-, and tri-glycerides and esters and amides of fatty acids are reacted with DEA in a molar ratio between about 1:1.5 and about 1:4, preferably between about 1:1.5 and about 1: 3, and more preferably between about 1:1.5 and about 1:2, say about 1:1.8. The reaction is conducted at a temperature of between about 120° C. and about 150° C. with stirring for about 2 to about 6 hours, under a nitrogen atmosphere with trace amounts of water distilled out of the reaction mixture. The product is cooled and filtered. It is postulated that the DEA and mixture of unsaturated mono-, di-, and tri-glycerides react to form an intermediate product mixture as follows:

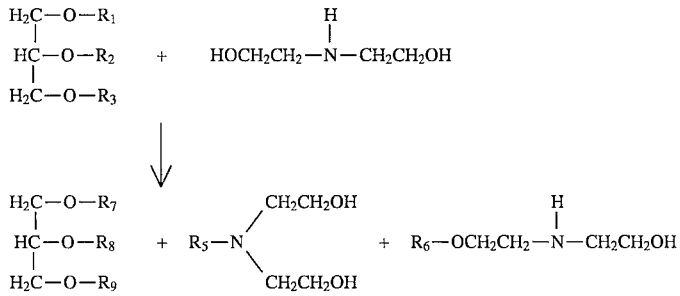

where $R_7$, $R_8$ and $R_9$ comprise hydrogen or hydrocarbyl radicals having the formula:

$$-\overset{\overset{\displaystyle O}{\|}}{C}-R_4$$

where $R_4$ is a $C_6$ to $C_{24}$ hydrocarbon, and where $R_5$ and $R_6$ comprise hydrocarbyl radicals having the formula:

$$-\overset{\overset{\displaystyle O}{\|}}{C}-R_4$$

where $R_4$ is a $C_6$ to $C_{24}$ hydrocarbon.

The intermediate product mixture is then reacted with DMTD as described above.

The lubricating oil composition of the present invention may be made by any procedure suitable for making lubricating oil compositions. Typically, the additive is added to the lubricant by simply mixing the components together at a temperature of about 65° C., producing a lubricant with increased wear resistance.

The lubricating oil component of the lubricating oil compositions can typically include one or any combination of the following: hydrocarbon oils, such as those having naphthenic base, paraffinic base, mixed base mineral oils; oils derived from coal products; synthetic oils, such as alkylene polymers including polypropylene and polyisobutylene having molecular weights of between about 250 and 2500; and the like. The type of lubricant can vary depending upon the particular application or properties desired.

The additive of the present invention may be added to the base lubricating oil in any minor, effective, wear inhibiting amounts. The additive can be added to the base lubricating oil in amounts of about 0.025 to about 5 wt. % based on the weight of the lubricating oil. Preferably the additive is added at a concentration of about 0.05 wt. % to about 2 wt. %, and more preferably at a concentration of about 1 to about 1.5 wt. %. The additive may be added separately, or as a component of an additive package which contains other additives.

The lubricant composition can contain, if desired, any other materials useful in lubricants. Such other materials include, among others, one or more of the following: dispersants; pour point depressants; detergents; viscosity index improvers; anti-foamants; anti-wear agents; demulsifiers; other anti-oxidants; other corrosion inhibitors; and other materials useful in lubricants. Preferred optional additives or additive packages include TLA-3604™, a product of the Texaco Additive Company. The amount of such materials may be any desired amounts which provide the desired properties.

The following examples illustrate the preparation of the novel reaction product of this invention.

EXAMPLE I 364.7 g of an ester/amide derived from coconut oil containing 0.10 mole equivalent double bond were combined in a 2 liter 3-neck flask equipped with a mechanical stirrer, thermocouple, thermometer, condenser and nitrogen inlet tube, with 15.0 g (0.10 m) DMTD. Nitrogen was bubbled into the mixture at 100 ml/min. and the mixture was stirred at 130° C. under a nitrogen atmosphere for three hours. The product was cooled and filtered.

| Yield = 319 g | Theory: 380 g | |
|---|---|---|
| Tests | Found | Theory |
| % N | 3.3 | 2.9 |
| % S | 2.18 | 2.5 |

EXAMPLE II

Into a 2 liter 3-neck flask equipped with a mechanical stirrer, thermocouple, thermometer, condenser and nitrogen inlet tube were added 336.0 g mixed mono-, di- and tri-glyceride esters of oleic acid containing 1.0 mole equivalent double bond which was reacted with 37.5 g (0.25 m) DMTD at 130° C. bubbling nitrogen at 100 ml/min. and stirring under a nitrogen atmosphere for 3 hours. The product was cooled and filtered.

| Yield = 334 g | Theory: 374 g | |
|---|---|---|
| Tests | Found | Theory |
| % S | 5.71 | 6.4 |
| % N | 1.8 | 1.9 |

EXAMPLE III

Into a 2 liter 3-neck flask equipped with a mechanical stirrer, thermocouple, thermometer, condenser and nitrogen inlet tube were added 336.0 g mixed mono, di- and tri-glyceride esters of oleic acid containing 1.0 mole equivalent double bond which was reacted with 75.0 g (0.50 m) DMTD at 130° C. bubbling nitrogen at 100 ml/min. and stirring under a nitrogen atmosphere for 3 hours. The product was cooled and filtered.

| Yield = 366 g | Theory: 411 g | |
|---|---|---|
| Tests | Found | Theory |
| % S | 10.4 | 11.7 |
| % N | 3.4 | 3.4 |

The products were evaluated for anti-wear properties in a Roxana Four-Ball Wear Tester. The four ball wear test machine uses four balls arranged in an equilateral tetrahedron. The lower three balls are clamped securely in a test cup filled with lubricant and the upper ball is held by a chuck which is motor driven, causing the upper ball to rotate against the fixed lower balls. Load is applied in an upward direction through a weight/lever arm system. Heaters allow operation at elevated oil temperatures. At the end of a run, the diameter of the scars on the three stationary balls are measured and averaged. The relative scar diameters o different test lubricants provides a relative measure of anti-wear properties. Tests were run using 12.7 mm. chrome alloy steel balls at 600 rpm, 40 kg. load and 200° F. for 30 minutes. Test results are reported in terms of mm. average wear scar diameter. The test samples were prepared using an SAE 30 base blend containing dispersant, detergent and antioxidant, and adding a pro-wear contaminant and anti-wear agents. The pro-wear contaminant added represents one found in engine service and is used at a dosage which enables good discrimination between anti-wear additives in a short test.

To demonstrate its effectiveness, the performance of the new additive in the wear test was compared to that of a known, effective zinc dithiophosphate (ZDTP) anti-wear additive in the test oil as shown in Table 1. The smaller the wear scar diameter, the better the anti-wear agent.

TABLE 1

FOUR BALL WEAR RESULTS

| Run No. | Additive | Concentration (weight %) | Four Ball Wear Test (Wear Scar Diameter mm.) |
|---|---|---|---|
| 1 | Typical ZDTP | 1.4 | 0.42 |
| 2 | " | 0.5 | 0.61 |
| 3 | Example I | 2.0 | 0.35 |
| 4 | " | 1.5 | 0.31 |
| 5 | " | 1.0 | 0.31 |
| 6 | Example II | 2.0 | 0.35 |
| 7 | " | 1.5 | 0.40 |
| 8 | " | 1.0 | 0.56 |
| 9 | Example III | 2.0 | 0.35 |
| 10 | " | 1.5 | 0.35 |
| 11 | " | 1.0 | 0.39 |
| 12 | Mixed mono-, di- and tri-glycerides | 2.0 | 0.44 |
| 13 | Mixed mono-, di- and tri-glycerides | 1.5 | 0.48 |
| 14 | Mixed mono-, di- and tri-glycerides | 1.0 | 0.53 |
| 15 | Base blend with no AW agent | — | 0.65 |

It is clear from the results of TABLE I that the products of the invention are strong anti-wear agents. In addition, the additives of the present invention performed better than a typical ZDTP anti-wear agent.

We claim:

1. An anti-wear additive comprising the reaction product of 2,5-dimercapto-1,3,4-thiadiazole and a mixture of unsaturated mono-, di-, and tri-glycerides of formula:

$$\begin{array}{l} H_2C-O-R_1 \\ | \\ HC-O-R_2 \\ | \\ H_2C-O-R_3 \end{array}$$

where $R_1$, $R_2$ and $R_3$ comprise hydrogen or radicals having the formula:

$$\begin{array}{c} O \\ \| \\ -C-R_4 \end{array}$$

where $R_4$ is a $C_6$ to $C_{24}$ unsaturated hydrocarbon.

2. The anti-wear additive of claim 1 where $R_4$ is a $C_{17}$ unsaturated hydrocarbon.

3. The anti-wear additive of claim 1 where the mixture of mono-, di, and tri-glycerides is reacted with diethanolamine prior to being reacted with the 2,5-dimercapto- 1,3,4-thiadiazole.

4. The anti-wear additive of claim 1 wherein the mixture of mono-, di-, and tri-glycerides comprises coconut oil.

5. The anti-wear additive of claim 1 wherein the mixture of mono, di-, and tri-glycerides comprises one or more of sunflower oil, lard or palm oil.

6. The anti-wear additive of claim 1 wherein the ratio of double bond equivalents in the mixture of mono-, di-, and tri-glycerides to moles of 2,5-dimercapto-1,3,4-thiadiazole is between about 4:1 and about 0.5:1.

7. The anti-wear additive of claim 1 wherein the ratio of double bond equivalents in the mixture of mono-, di-, and tri-glycerides to moles of 2,5-dimercapto-1,3,4-thiadiazole is about 1:1.

8. A lubricating composition comprising a major portion of a lubricating oil and a minor portion, effective to impart anti-wear properties to the lubricating composition of an additive comprising the reaction product of 2,5-dimercapto-1,3,4-thiadiazole and a mixture of unsaturated mono-, di-, and tri-glycerides of formula:

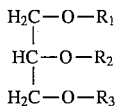

where $R_1$, $R_2$ and $R_3$ comprise hydrogen or hydrocarbyl radicals having the formula:

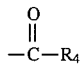

where $R_4$ is a $C_6$ to $C_{24}$ unsaturated hydrocarbon.

9. The lubricating composition of claim 8 wherein the mixture of mono-, di-, and tri-glycerides comprises coconut oil.

10. The lubricating composition of claim 8 wherein the mixture of mono-, di-, and tri-glycerides comprises one or more of sunflower oil, lard or palm oil.

11. The lubricating composition of claim 8 where $R_4$ is a $C_{17}$ unsaturated hydrocarbon.

12. The lubricating composition of claim 8 where the mixture of mono-, di-, and tri-glycerides is reacted with the 2,5-dimercapto-1,3,4-thiadiazole in a ratio between about 4:1 and about 0.5:1.

13. The lubricating composition of claim 8 where the mixture of mono-, di-, and tri-glycerides is reacted with the 2,5-dimercapto-1,3,4-thiadiazole in a ratio between about 1:1.

14. The lubricating composition of claim 8 where the additive is present at a concentration of about 0.025 to about 5 wt %.

15. The lubricating composition of claim 8 where the additive is present at a concentration of about 0.05 to about 2 wt %.

16. The lubricating composition of claim 8 where the additive is present at a concentration of about 1 to about 1.5 wt %.

17. A lubricating composition comprising a major portion of a lubricating oil and a minor portion, effective to impart anti-wear properties to the lubricating composition of an additive produced by the steps comprising:

reacting a mixture of unsaturated mono-, di-, and tri-glycerides of formula:

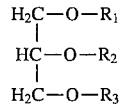

where $R_1$, $R_2$ and $R_3$ comprises hydrogen or a radical having the formula:

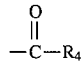

where $R_4$ is a $C_6$ to $C_{24}$ unsaturated hydrocarbon, with diethanolamine to provide an intermediate reaction product; and reacting the intermediate reaction product with 2,5-dimercapto-1,3,4-thiadiazole.

18. The lubricating composition of claim 17 wherein the mixture of mono-, di-, and tri-glycerides comprises coconut oil.

19. The lubricating composition of claim 17 wherein the mixture of mono-, di-, and tri-glycerides comprises one or more of sunflower oil, lard or palm oil.

20. The lubricating composition of claim 17 where the intermediate reaction product is reacted with the 2,5-dimercapto-1,3,4-thiadiazole in a ratio between about 4:1 and about 0.5:1.

21. The lubricating composition of claim 17 where the intermediate reaction product is reacted with the 2,5-dimercapto-1,3,4-thiadiazole in a ratio between about 1:1.

22. The lubricating composition of claim 17 where the additive is present at a concentration of about 0.025 to about 5 wt %.

23. The lubricating composition of claim 17 where the additive is present at a concentration of about 0.05 to about 2 wt %.

24. The lubricating composition of claim 17 where the additive is present at a concentration of about 1 to about 1.5 wt %.

* * * * *